United States Patent [19]

Baker

[11] 4,033,252

[45] July 5, 1977

[54] PRESSES

[75] Inventor: Cyril Walter Baker, Birmingham, England

[73] Assignee: Cincinnati Milacron, Inc., Cincinnati, Ohio

[22] Filed: Mar. 15, 1976

[21] Appl. No.: 666,924

[52] U.S. Cl. ..... 100/99; 100/257

[51] Int. Cl.[2] ..... B30B 15/00

[58] Field of Search ..... 100/99, 257, 282, DIG. 18; 83/522, 468, 527, 530; 72/31, 32, 35, 36; 156/378

[56] References Cited

UNITED STATES PATENTS

| | | | |
|---|---|---|---|
| 2,889,507 | 6/1959 | Kennedy | 100/257 X |
| 3,118,407 | 1/1964 | Robb | 100/99 X |
| 3,162,232 | 12/1964 | Munschauer | 100/257 X |
| 3,334,581 | 8/1967 | Bergman | 100/257 |
| 3,687,069 | 8/1972 | Helrigel | 100/99 X |

*Primary Examiner*—Billy J. Wilhite
*Attorney, Agent, or Firm*—Jack J. Earl

[57] ABSTRACT

This patent application discloses a mechanism for indicating the shut height in a mechanical press mechanism. It measures the absolute shut height though the press is shown having a variable stroke mechanism.

5 Claims, 4 Drawing Figures

PRESSES

BACKGROUND

This invention relates to presses of the kind (hereinafter referred to as the kind specified) comprising a body which includes a bed and a frame, a slide which is supported on the frame for reciprocation towards and away from the bed and means for so reciprocating the slide.

When a set of tools is fitted to a press, one part of the set being mounted on the bed and another part on the slide, it is necessary to ensure that the distance between the slide and the bed for accommodation of the tools corresponds to the height of the set of tools when closed. The distance between the slide and bed when the slide is in its bottom dead-center position is called herein the shut height of the press.

Presses which are intended to be fitted at different times with different sets of tools normally have a device for adjusting the shut height and such device is commonly adapted to adjust the position of the slide relative to a connecting rod by means of which drive is transmitted from a crankshaft of the press to the slide. Such adjustment device is also commonly associated with indicating means for indicating the position of the slide relative to the connecting rod, so that these can be set in a required relative position.

Different sets of tools which are fitted to a press sometimes require the press to have respective different strokes. Accordingly, means are provided in some presses of the kind specified for adjusting the stroke.

When a set of tools is fitted to a press, the shut height of the press is normally adjusted by a trial and error procedure. For example, the position of the slide relative to the connecting rod is adjusted to a position which the setter estimates to be the required relative position. The crankshaft of the press is then turned manually to move the slide towards the bed and, if the bottom dead-center position can be reached, the relative position of the tools is then ascertained and the position of the slide relative to the connecting rod adjusted accordingly. If the same set of tools is fitted to the press on a subsequent occasion, it is possible to reproduce the shut height previously found to be appropriate by setting the size of the stroke and the position of the slide relative to the connecting rod exactly as on the previous occasion. This procedure occupies a significant period of time. Furthermore, it may not be carried out accurately and before the press can be set into operation it is important that the trial and error procedure should be carried out with the crankshaft turned manually, in order to avoid the risk of damage to the tools and/or to the press.

SUMMARY OF THE INVENTION

According to the present invention we provide in a press of the kind specified having adjustment means for adjusting the shut height, a device for indicating the position of the slide relative to the bed and comprising a first element on or constituted by the slide, a second element on the body or constituted by a part thereof, sensing means which cooperates in use with the first and second elements to sense relative displacement thereof independently of the adjustment means, and indicator means associated with the sensing means for indicating the position of the slide relative to the bed.

With a press in accordance with the invention, the shut height can quickly be ascertained and set to a required value. The slide is moved to the bottom dead-center position. This can be checked by rocking the crankshaft to-and-fro and observing the indicator means. With the slide at rest in the bottom dead-center position, the indicator means indicates the shut height. As relative displacement of the bed and slide is sensed independently of the adjustment means, the indication of the shut height is not dependent upon the stroke of the press being unchanged, in a case where the stroke is variable.

The sensing means may comprise a third element which, when the device is in use, engages and remains stationary with respect to one of said first and second elements and is movable relative to said one element to disengage same when the device is not in use.

With this arrangement, working parts of the device need not be subjected to continuous motion and consequent wear when the press is operating and an indication of the shut height is no longer required.

THE DRAWINGS

The invention will now be described by way of example with reference to the accompanying drawings, wherein:

FIG. 1 shows diagrammatically a press of the kind specified including a device in accordance with the invention, FIG. 2 shows on an enlarged scale a fragmentary sectional view on the line 2—2 of FIG. 1, a slide of the press being in a mid-stroke position, FIG. 3 is a sectional view on the line 3—3 of FIG. 2, and FIG. 4 is a sectional view on the line 4—4 of FIG. 3.

DETAILED DESCRIPTION

Figure 1:
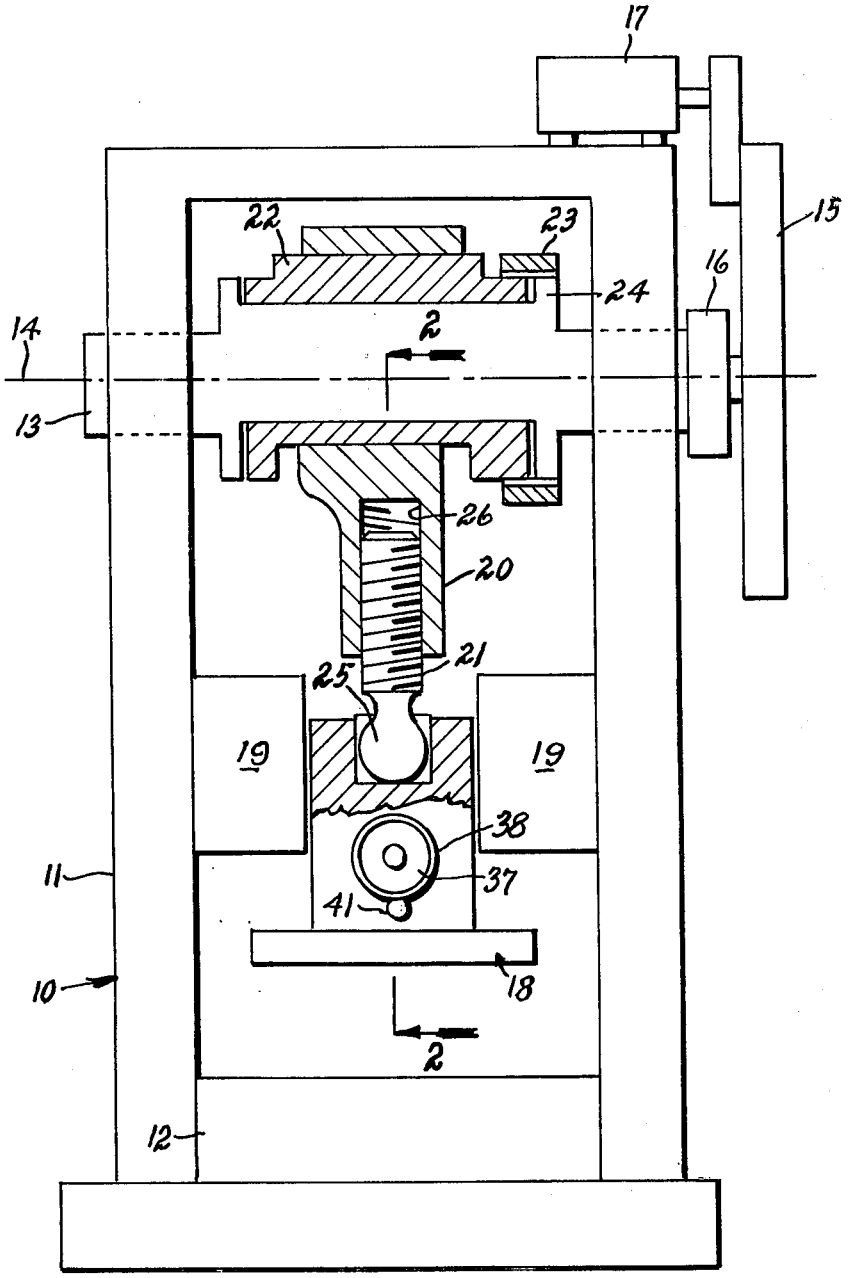

The press shown in the accompanying drawings comprises a body 10 which includes a frame 11 and a bed 12 situated at the lower end of the frame and fixed with respect thereto. A crankshaft 13 is supported in an upper part of the frame for rotation relative thereto about a horizontal axis 14. On one end portion of the crankshaft which protrudes laterally from the frame there is mounted a flywheel 15 and a clutch 16 whereby the crankshaft can be coupled to the flywheel for rotation therewith. An electric motor 17 for driving the flywheel is mounted on top of the frame.

The press further comprises a slide 18 which is disposed between the crankshaft 13 and the bed 12 for reciprocation towards and away from the bed. The slide is guided for rectilinear movement by members 19 fixed to the frame. The slide is connected by the crankshaft 13 by a connecting rod 20 and a ball pin 21.

A mid-portion of the crankshaft 13 is eccentric with respect to the axis 14 and on this eccentric portion there is rotatably mounted an eccentric bush 22. The bush is received in a bearing opening in the upper end of the connecting rod 20. The bush 22 can be turned about the crankshaft 13 to vary the throw of the crankshaft and therefore the stroke of the slide 18. The bush is releaseably held in a required position with respect to the crankshaft by a locking ring 23 which is releasably engaged with gear teeth formed on the bush 22 and with similar teeth formed on a flanged 24 of the crankshaft.

The ball pin 21 has a part-spherical head 25 which is received within a part-spherical socket provided in the slide 18. A screw-threaded shank of the ball pin extends upwardly from the head 25, this shank being received within a screw-threaded bore 26 formed in the connecting rod 20. By screwing the ball pin into or out of the bore 26, the slide 18 can be adjusted upwardly and downwardly with respect to the connecting rod 20. In this way, the distance between the slide 18 and the bed 12 when the slide is in its bottom dead-center position, the shut height of the press, can be adjusted. It will be appreciated that the ball pin and the female screw thread in the bore 26 constitute the adjustment means hereinbefore referred to. Means not shown in the drawings is provided for rotating the ball pin 21 and for holding it in a position to which it has been set.

Figure 2:
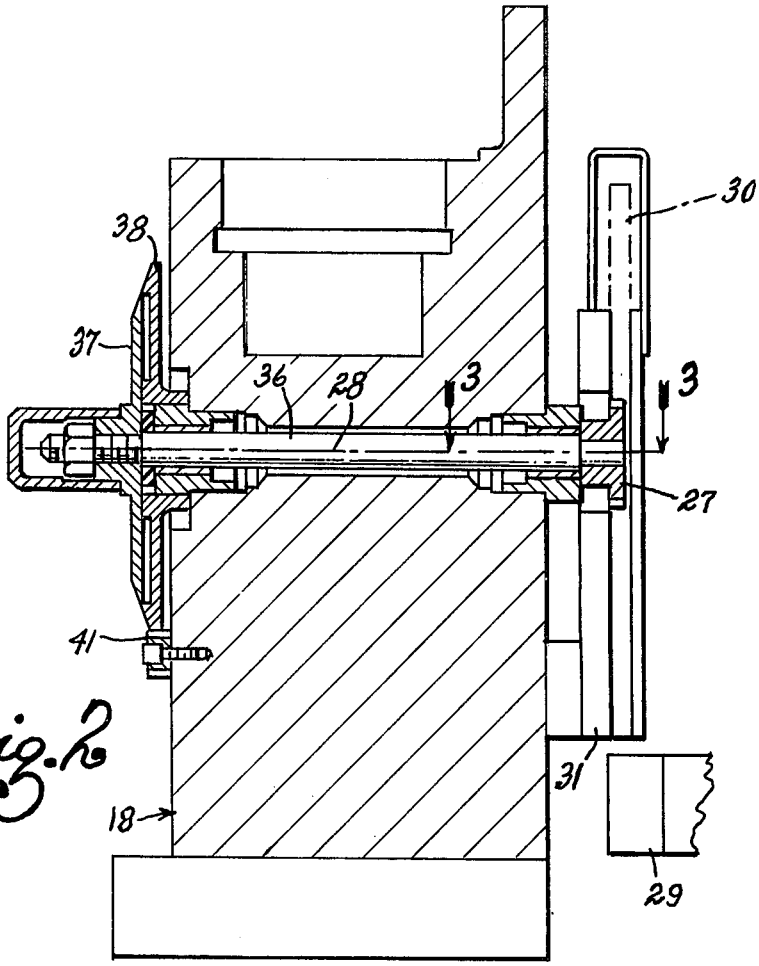
Figure 3:
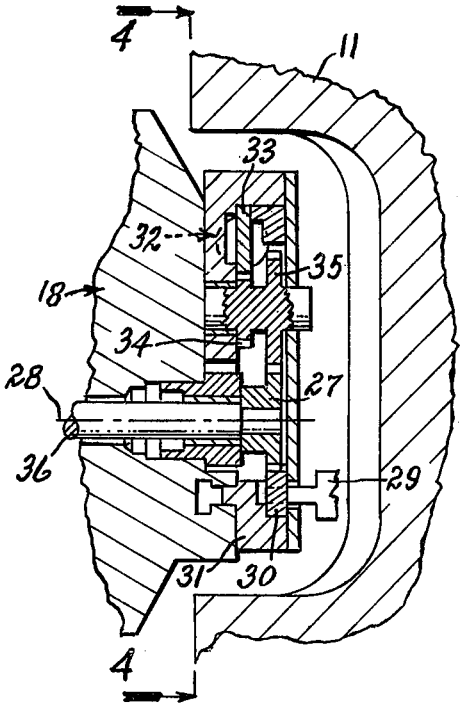

The press further includes a device for indicating the position of the slide 18 relative to the bed 12. This device is illustrated in detail in FIGS. 2, 3 and 4. The device comprises a first element in the form of a pinion 27 mounted on the slide 18 at the rear side thereof for rotation about a horizontal axis 28 which extends from front to rear of the press. The axis 28 is fixed with respect to the slide. A second element 29 which forms an abutment is rigidly secured to the frame 11 and projects therefrom into a position which is just to the rear of the slide 18 when the latter is in the lowest position which it can reach. A third element of the device in the form of a rack 30 cooperates directly with the pinion 27 and with the abutment element 29 and responds to relative displacement of these by causing the pinion 27 to rotate. The rack also senses the position of the pinion relative to the abutment element.

The rack 30 is mounted in a carrier 31 and is guided thereby for reciprocation along a vertical guideway towards and away from the abutment element 29. The carrier is secured to the slide 18 in a fixed position with respect thereto. The device further includes biasing means for urging the rack 30 towards the abutment element 29, this biasing means being in the form of a pneumatic piston and cylinder unit 32 whereof the cylinder is rigidly secured to the slide 18. The piston of the unit 32 is arranged for reciprocation along a vertical path and is connected with a further rack 33 which meshes with a further pinion 34. The pinion 34 is mounted together with a third pinion 35 for rotation about an axis which is parallel to the axis 14 and which is also fixed with respect to the slide 18. The pinions 34 and 35 are keyed to each other, or to a common shaft. The pinion 35 meshes with the pinion 27 which in turn meshes with the rack 30, the arrangement being such that when the piston and cylinder unit 32 is contracted the rack 30 is driven downwardly from the pisition shown in FIG. 4 relative to the slide into engagement with the element 29. When the unit 32 is expanded, the rack 30 is withdrawn into the carrier 31 as shown and clear of the element 29.

A device further comprises indicator means for indicating the position of the slide 18 relative to the bed 12. This indicator means comprises a shaft 36 on one end of which the pinion 27 is keyed. The shaft is mounted in the slide 18 for rotation about the axis 28 and on a front end portion of the shaft there is keyed a dial 37 having a linear scale marked around its periphery. The dial 37 is situated at the front end of the slide 18 where it can readily be observed by an operator. Between the slide and the dial 37 there is disposed a circular plate 38 having a diameter somewhat greater than that of the dial 37 so that the periphery of the plate 38 is visible. The plate 38 carries a datum mark against which the scale on the dial 37 can be read. If required, the plate 38 may be marked with a Vernier scale to assist accurate reading of the scale on the dial.

At the side of the rack carrier 31 which faces towards the axis 28 there is formed a flat face 39 which is inclined slightly to the longitudinal center line of the guideway along which the rack 30 moves. Adjacent to the lower end of the rack, the face 39 is nearer to a vertical plane containing the axis 28 than is the face 39 adjacent to the upper end of the rack. The face 39 abuts a complementary face 40 formed on the slide 18, the face 40 being similarly inclined to the vertical. When the carrier 31 and rack 30 are assembled on the slide, the carrier is adjusted vertically with respect to the slide to adjust the distance between the axis 28 and the rack 30 so that backlash between the pinion 27 and the rack is substantially eliminated. The carrier is then rigidly secured to the slide.

The press is intended to be fitted with a set of tools (not shown) which, when the press is in use, act on work fed between the tools. A first tool of the set is secured to the underside of the slide 18 and a second tool of the set is secured on top of the bed 12. When the slide moves away from the bed, the tools move apart so that work can be fed between them. When the slide descends, the tools move together and it is important that the distance between the slide and the bed when the slide is in its bottom dead-center postion, the shut height of the press, should correspond exactly to the overall height dimension of the set of tools when the tools are closed together. The distance separating the tools when the slide is in its top dead-center position can be adjusted by adjustment of the bush 22 about the crankshaft 13, but this separation is not as critical as is the shut height of the press.

When a set of tools is first fitted to the press, the stroke of the press is adjusted to an appropriate value and the crankshaft is then turned manually to move the slide 18 towards the bed, if possible, into the bottom dead-center position. Air is then supplied to the piston and cylinder unit 32 to contract this unit and move the rack 30 into engagement with the abutment element 29. A check can then be made as to whether the slide is in the bottom dead-center position by rocking the crankshaft to-and-fro. If, while the crankshaft is turning in one direction, the distance between the slide and bed indicated on the dial 37 falls to a minimum and then increases, the position of the slide when the indication of the dial is a minimum is the bottom dead-center position. With the slide in the bottom dead-center position, the position of the first tool relative to the second tool is adjusted by screwing the ball pin 21 into or out of the bore 26. When the tools are in the correct relative position, the shut-height of the press, as indicated on the dial 37, is noted. It will normally be necessary to carry out a trial and error procedure to determine whether the relative position of the tools when the slide is in the bottom dead-center position is correct. For example, the crankshaft may be turned over manually with work positioned between the tools, the position of the slide relative to the connecting rod adjusted and this procedure repeated until the setter is satisfied that the optimum setting has been achieved. This procedure may occupy a considerable period of time, during which the press is not usefully employed.

Figure 4:
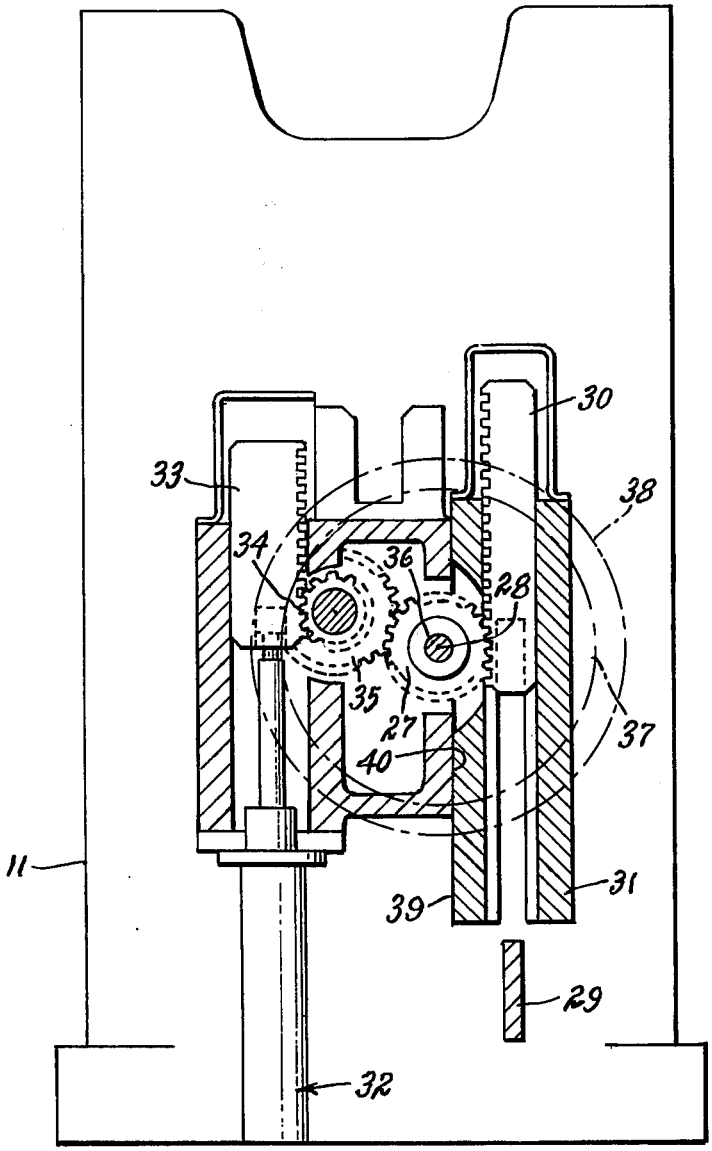

When the setting is correct, the piston and cylinder unit 32 is extended as shown in FIG. 4 to withdraw the rack 30 from the abutment 29 and power-driven operation of the press can then commence. It will be noted that the unit 32 yieldably urges the rack 30 into engagement with the element 29, so that the rack remains in engagement with this element during movement of the slide relative to the bed and adjustments of the position of the slide relative to the bed will be indicated on the dial 37.

If the same set of tools is fitted on a subsequent occasion to the press, a quicker procedure can be adopted to set the shut height of the press to the previously noted value. If necessary, the stroke of the press is adjusted although it is generally not essential that the stroke should be exactly equal to the stroke previously used for the same set of tools. The slide is then moved to the bottom dead-center position by manual rotation of the crankshaft 13 and the piston and cylinder unit 32 is contracted. The shut height, as indicated on the dial 37 is then compared with the previously noted shut height. If necessary, the ball pin 21 is screwed into or out of the bore 26, the rack 30 remaining in engagement with the element 29 so that the shut height is indicated during the adjustment. Thus, the shut height can quickly be set to the previously noted value and when the unit 32 is contracted, the press is ready for use.

When the press is being built, it is necessary to set the relative positions of the dial 37 and plate 38 so that the shut height indicated on the dial is the true distance between the slide 18 and the bed 12. The dial 37 can be adjusted relative to the plate 38 in relatively coarse steps by turning the dial while the pinion 27 is disengaged from the rack 30 before the carrier 31 is rigidly secured to the slide. After this coarse setting has been carried out, a relatively fine adjustment is effective by rotating the plate 38 relative to the slide. When the plate has been set in the required position, it is securely clamped to the slide. To pevent subsequent rotation of the plate 38 relative to the slide, a part of the peripheral surface of the plate may be formed with a series of serrations which engage with complementary serrations on a pad 41 which is secured to the slide. The pad 41 may be arranged for limited adjustment relative to the slide in the lateral direction to enable a very fine adjustment of the plate 38 relative to the slide to be carried out.

In order to ensure that the rack 30 is always withdrawn clear of the abutment element 29 before power-driven operation of the press is commenced, there may be provided an interlock which prevents simultaneous engagement of the clutch 16 and supply of air to the unit 32 to contract this unit. If required, the press may alternatively be so arranged that the distance between the slide and press is continuously indicated. For example, the rack 30 may be secured to the element 29 or to the body of the press. In this case, the unit 32 and the pinions 34 and 35 would be dispensed with.

What is claimed is:

1. In a press mechanism having means for adjusting the shut height, a device for indicating the instantaneous position of a movable slide relative to a fixed frame comprising:

a. a first rack slidably supported in the slide and adapted to engage the frame and remain stationary relative thereto when biased in one direction outward from the slide;

b. means alternatively for yieldably biasing said first rack in the one direction and for moving the first rack in the other direction for withdrawal into the slide and away from contact with the frame;

c. a pinion carried by the slide and in mesh with the first rack; and d. an indicator on the slide driven by the pinion and operative to display the position of the slide relative to the frame when the first rack engages the frame.

2. The device of claim 1, wherein:

a. a rack carrier is attached to the slide and defines a guideway along which the first rack moves in a direction parallel to the direction of movement of the slide relative to the frame;

b. an abutment extends from the frame to a position in alignment with the rack carrier; and c. the first rack is moved in said one direction along the rack carrier to extend therefrom to yieldably engage said abutment and in the other of said directions to a position out of contact with said abutment.

3. The device of claim 2, wherein:

a. the means for biasing is a piston and cylinder motor connected to a second rack for reciprocation thereof; and b. the second rack is mechanically connected to rotate the pinion and to drive the first rack in one and the other directions.

4. The device of claim 3, wherein the pinion and second rack and the piston and cylinder motor are supported on the slide.

5. The device of claim 2, wherein:

a. a first face is formed on the rack carrier inclined at an acute angle to the direction of movement of the first rack in the rack carrier;

b. a second face complementary to the first face is formed on the slide and abuts the first face; and c. said rack carrier fixed to the slide in a selected position wherein interaction of said first and second faces positions the pinion in backlash-free engagement with the first rack.

* * * * *